US007118335B2

(12) United States Patent
Vacarezza et al.

(10) Patent No.: US 7,118,335 B2
(45) Date of Patent: Oct. 10, 2006

(54) COMPRESSOR WHEEL AND SHIELD

(75) Inventors: Stephen Vacarezza, Torrance, CA (US); Voytek Kangowski, Fountain Valley, CA (US)

(73) Assignee: Honeywell International, Inc., Morristown, NJ (US)

( * ) Notice: Subject to any disclaimer, the term of this patent is extended or adjusted under 35 U.S.C. 154(b) by 133 days.

(21) Appl. No.: 10/811,002

(22) Filed: Mar. 26, 2004

(65) Prior Publication Data

US 2005/0214123 A1 Sep. 29, 2005

(51) Int. Cl.
*F04D 29/38* (2006.01)

(52) U.S. Cl. ..... 415/229; 416/244 R

(58) Field of Classification Search ..... 415/229, 415/230, 231; 416/244 A, 248
See application file for complete search history.

(56) References Cited

U.S. PATENT DOCUMENTS 4,705,463 A 11/1987 Joco
4,944,660 A * 7/1990 Joco ..... 417/407
4,986,733 A 1/1991 Fleury et al.
5,176,497 A 1/1993 Deacon et al.
5,193,989 A 3/1993 Fleury et al.
6,164,931 A 12/2000 Norton et al.
6,948,913 B1 * 9/2005 Heyes et al. ..... 416/204 R

* cited by examiner

*Primary Examiner*—Edward K. Look
*Assistant Examiner*—Dwayne J White
(74) *Attorney, Agent, or Firm*—Chris James; Brian Pangrle

(57) ABSTRACT

An exemplary shield includes an attachment mechanism disposed on an outer surface to attach the shield to a joint of a boreless compressor wheel and a passage extending from a proximate end of the shield to a distal end of the shield. An exemplary method includes inserting a shield at least partially in a joint of a boreless compressor wheel and treating, at least partially, an end surface of the joint to thereby reduce fatigue of the boreless compressor wheel. Other exemplary joints, compressor wheels, shields, etc., are also disclosed.

23 Claims, 9 Drawing Sheets

COMPRESSOR WHEEL AND SHIELD

TECHNICAL FIELD

Subject matter disclosed herein relates generally to compressors and, in particular, compressor wheels suitable for use with internal combustion engines.

BACKGROUND

Compressor wheels experience significant tensile stresses when rotated at high speeds, for example, compressor wheels used to assist internal combustion engine may be rotated at speeds in excess of 100,000 revolutions per minute. Further, fatigue can occur as rotational speed and other operating conditions vary. Fatigue may be defined as failure under a repeated or otherwise varying load, which does not reach a level sufficient to cause failure in a single application. Fatigue is known to be an issue for lightweight compressor wheels which are typically made from cast or forged aluminum alloy that may have impurities that are difficult to control. Fatigue is often associated with small scale cracks that develop in response to cyclic plastic deformations in a localized region. Such cracks usually originate at a preexisting, small scale defect at a material surface, which may be associated with impurities, manufacturing processes, etc. Consequently, surface quality can have a profound effect on crack initiation and hence fatigue.

To improve surface quality of a component, and thereby fatigue resistance, a variety of surface treatment techniques have been developed. Such techniques usually aim to induce a residual compressive stress at the surface of a material that can counter tensile stress associated with loading. One class of techniques are known as "cold working" techniques or processes. Cold working processes include shot peening and others. In shot peening, a surface is bombarded with small particles called shot that create dimples. Overlapping dimples develop a layer of residual compressive stress. Surface regions under compressive stress seldom initiate or propagate cracks. Shot peening can also increase surface hardness of a material.

Recently, cold working processes have been applied to conventional compressor wheels. U.S. Pat. No. 6,146,931 to Norton et al. discloses use of cold working processes to treat the bore of a conventional compressor wheel and thereby reduce failure caused by operational tensile loading. Norton et al. define the bore by an inner circumference that extends the entire length of the conventional compressor wheel. Their cold working process treats the entire inner circumference surface that defines the bore.

For a variety of reasons, "boreless" compressor wheels have been developed that include a joint that does not extend the entire length of the compressor wheel; thus, boreless compressor wheels cannot employ a shaft that extends the length of the wheel. Further, fatigue characteristics of a boreless compressor wheel differ from those of a conventional compressor wheel. Exemplary devices, methods, systems, etc. are presented below that address fatigue reduction in boreless compressor wheels.

BRIEF DESCRIPTION OF THE DRAWINGS

A more complete understanding of the various method, systems and/or arrangements described herein, and equivalents thereof, may be had by reference to the following detailed description when taken in conjunction with the accompanying drawings wherein.

DETAILED DESCRIPTION

Various exemplary devices, systems and/or methods disclosed herein address issues related to compressors. For example, as described in more detail below, various exemplary devices, systems and/or methods address balancing of a compressor wheel.

An overview of turbocharger operation is presented below followed by a description of a conventional compressor wheel bore, a boreless compressor wheel, exemplary compressor wheel joints, stress data for various compressor wheel joints, an exemplary shield and an exemplary method of surface treating at least part of a boreless compressor wheel joint.

Figure 1:
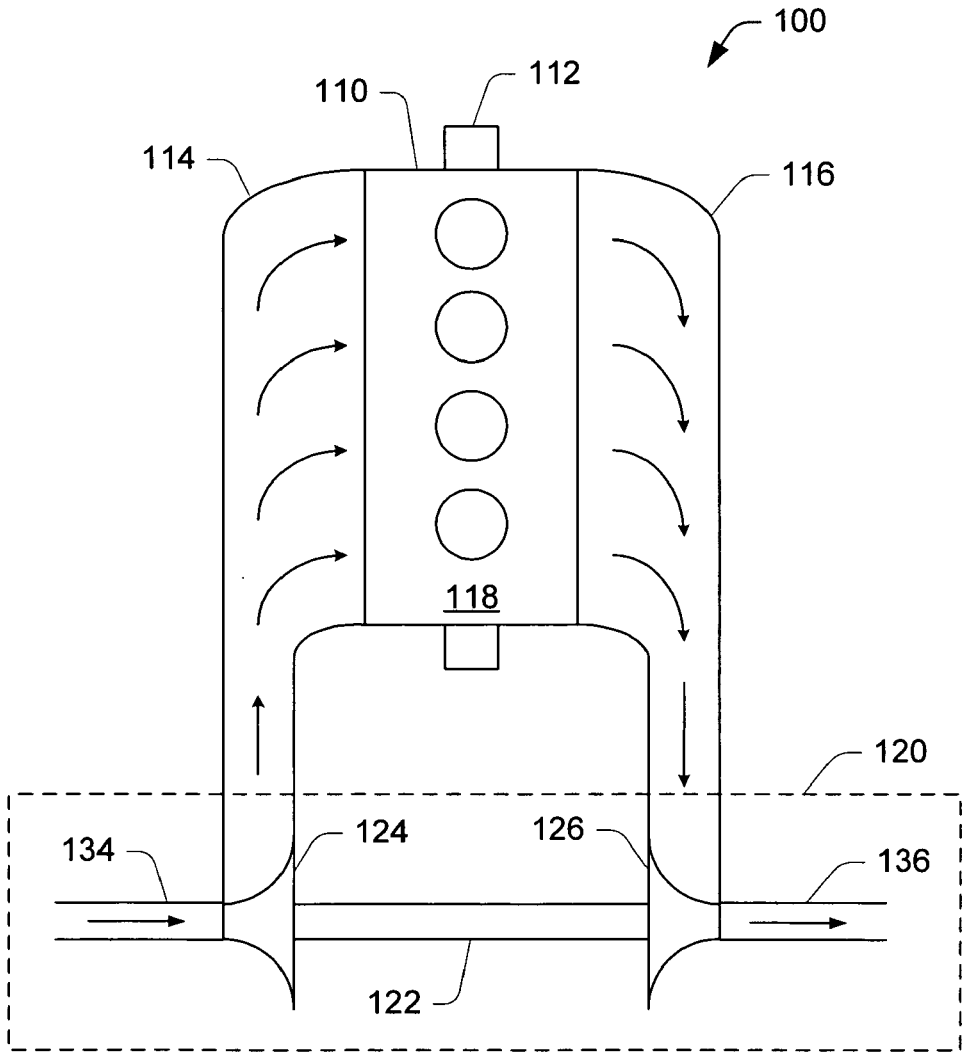
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, and an exhaust outlet 136. A wastegate or other mechanism may be used in conjunction with such a system to effect or to control operation.

The turbine 126 optionally includes a variable geometry unit and a variable geometry controller. The variable geometry unit and variable geometry controller optionally include features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine rotor in order to optimize turbine power with the required load. Movement of vanes towards a closed position typically directs exhaust flow more tangentially to the turbine rotor, which, in turn, imparts more energy to the turbine and, consequently, increases compressor boost. Conversely, movement of vanes towards an open position typically directs exhaust flow in more radially to the turbine rotor which, in turn, increase the mass flow of the turbine and, consequently, decreases the engine back pressure (exhaust pipe pressure). Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, various mechanisms may allow for boost pressure regulation which may effectively optimize power output, fuel efficiency, emissions, response, wear, etc. Of course, an exemplary turbocharger may employ wastegate technology as an alternative or in addition to aforementioned variable geometry technologies. Other exemplary turbochargers may include neither or other mechanisms.

Figure 2:
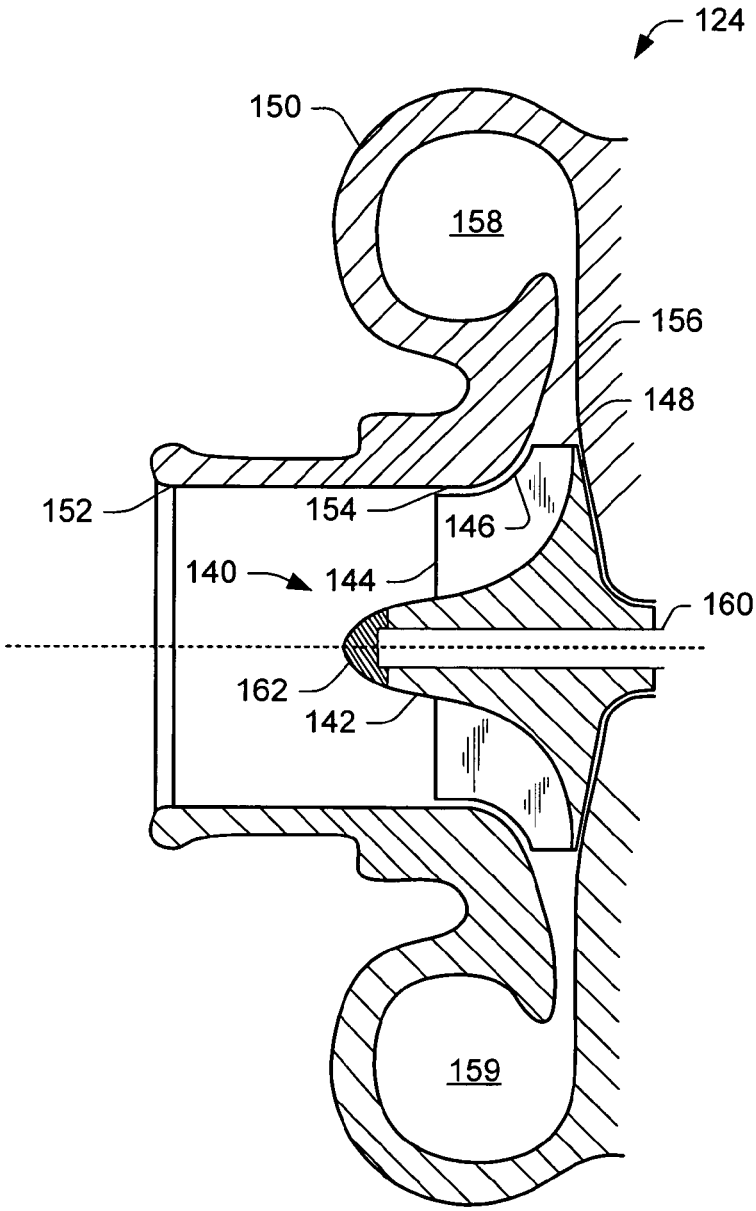
Fig. 2 (Prior Art)
FIG. 2 is a cross-sectional view of a prior art compressor assembly that includes a compressor shroud and a compressor wheel having a full bore.

FIG. 2 shows a cross-sectional view of a typical prior art compressor assembly 124 suitable for use in the turbocharger system 120 of FIG. 1. The compressor assembly 124 includes a housing 150 for shrouding a compressor wheel 140. The compressor wheel 140 includes a rotor 142 that rotates about a central axis (e.g., a rotational axis). A bore 160 extends the entire length of the central axis of the rotor 142 (e.g., an axial rotor length). An end piece 162 fits onto an upstream end of the rotor 142 and may act to secure a shaft and/or to reduce disturbances in air flow. In general, such a shaft has a compressor end and a turbine end wherein the turbine end attaches to a turbine capable of being driven by an exhaust stream.

Referring again to the compressor wheel 140, attached to the rotor 142, are a plurality of compressor wheel blades 144, which extend radially from a surface of the rotor. As shown, the compressor wheel blade 144 has a leading edge portion 144 proximate to a compressor inlet opening 152, an outer edge portion 146 proximate to a shroud wall 154 and a trailing edge portion 148 proximate to a compressor housing diffuser 156. The shroud wall 154, where proximate to the compressor wheel blade 144, defines a section sometimes referred to herein as a shroud of compressor volute housing 150. The compressor housing shroud wall after the wheel outlet 156 forms part of a compressor diffuser that further diffuses the flow and increases the static pressure. A housing scroll 158, 159 acts to collect and direct compressed air.

In this example, some symmetry exists between the upper portion of the housing scroll 158 and the lower portion of the housing scroll 159. In general, one portion has a smaller cross-sectional area than the other portion; thus, substantial differences may exist between the upper portion 158 and the lower portion 159. FIG. 2 does not intend to show all possible variations in scroll cross-sections, but rather, it intends to show how a compressor wheel may be positioned with respect to a compressor wheel housing.

Figure 3:
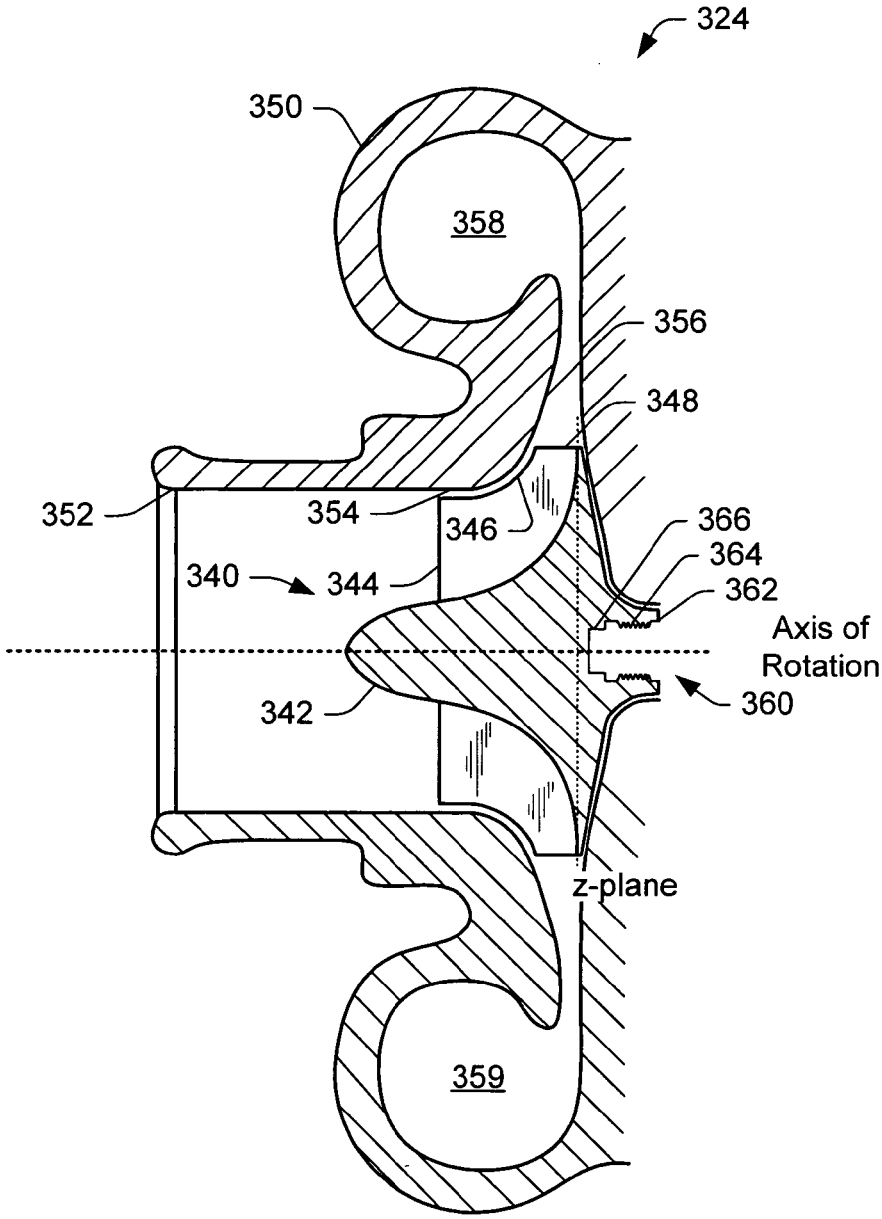
Fig. 3 (Prior Art)
FIG. 3 is a cross-section view of a prior art compressor assembly that includes a compressor shroud and a "boreless" compressor wheel.

FIG. 3 shows a cross-sectional view of a prior art compressor wheel rotor 324 that includes a "boreless" compressor wheel 340 suitable for use in the turbocharger system 120 of FIG. 1. The compressor assembly 324 includes a housing 350 for shrouding a compressor wheel 340. The compressor wheel 340 includes a rotor 342 that rotates about a central axis. Attached to the rotor 342, are a plurality of compressor wheel blades 344, which extend radially from a surface of the rotor. As shown, the compressor wheel blade 344 has a leading edge portion 344 proximate to a compressor inlet opening 352, an outer edge portion 346 proximate to a shroud wall 354 and a trailing edge portion 348 proximate to a compressor housing diffuser 356. The shroud wall 354, where proximate to the compressor wheel blade 344, defines a section sometimes referred to herein as a shroud of compressor volute housing 350. The compressor housing shroud wall after the wheel outlet 356 forms part of a compressor diffuser that further diffuses the flow and increases the static pressure. A housing scroll 358, 359 acts to collect and direct compressed air.

In this example, some symmetry exists between the upper portion of the housing scroll 358 and the lower portion of the housing scroll 359. In general, one portion has a smaller cross-sectional area than the other portion; thus, substantial differences may exist between the upper portion 358 and the lower portion 359. FIG. 3 does not intend to show all possible variations in scroll cross-sections, but rather, it intends to show how a compressor wheel may be positioned with respect to a compressor wheel housing.

FIG. 3 shows a z-plane as coinciding substantially with a lowermost point of an outer edge or trailing edge portion 348 of the blade 344. A joint 360 centered substantially on a rotor axis exists at a proximate end of the rotor 342 for receiving a shaft. Throughout this disclosure, the joint 360 is, for example, a place at which two or more things are joined (e.g., a compressor wheel and a shaft or a spindle, etc.). Compressor wheels having a joint such as the joint 360 are sometimes referred to as "boreless" compressor wheels in that the joint does not pass through the entire length of the compressor wheel. Such boreless compressor wheels do not usually have joints that extend to the depth of the z-plane. Various exemplary shields, methods, systems, etc., may apply to boreless compressor wheels that have joints that extend to or beyond the z-plane. In particular, surface treatment techniques described herein may in some instances reduce fatigue and thereby allow for a boreless compressor wheel that includes an extended joint (e.g., a joint that extends deeper into the compressor wheel when compared to a boreless joint that does not include use of a surface treatment described herein). Referring again to FIG. 3, the joint 360 typically receives a shaft that has a compressor end and a turbine end wherein the turbine end attaches to a turbine capable of being driven by an exhaust stream. As shown, the joint 360 may be defined by one or more regions, volumes, surfaces and/or dimensions. The joint 360 includes a proximate region 362, an intermediate region 364 and a distal region 366. Of course, a joint may have more or fewer regions. The proximate region 362 of the joint 360 may include a pilot surface for a shaft or spindle; the intermediate region 364 of the joint 360 may include threads, bayonet, or one or more other attachment mechanisms that communicate with an attachment mechanism of a shaft or spindle; and the distal region 366 of the joint 360 includes an end surface and optionally a pilot surface. The end surface of the distal region 366 has a substantially flat profile, orthogonal to the rotational axis of the compressor wheel. Other joints may have end surfaces with different profiles.

Figure 4:
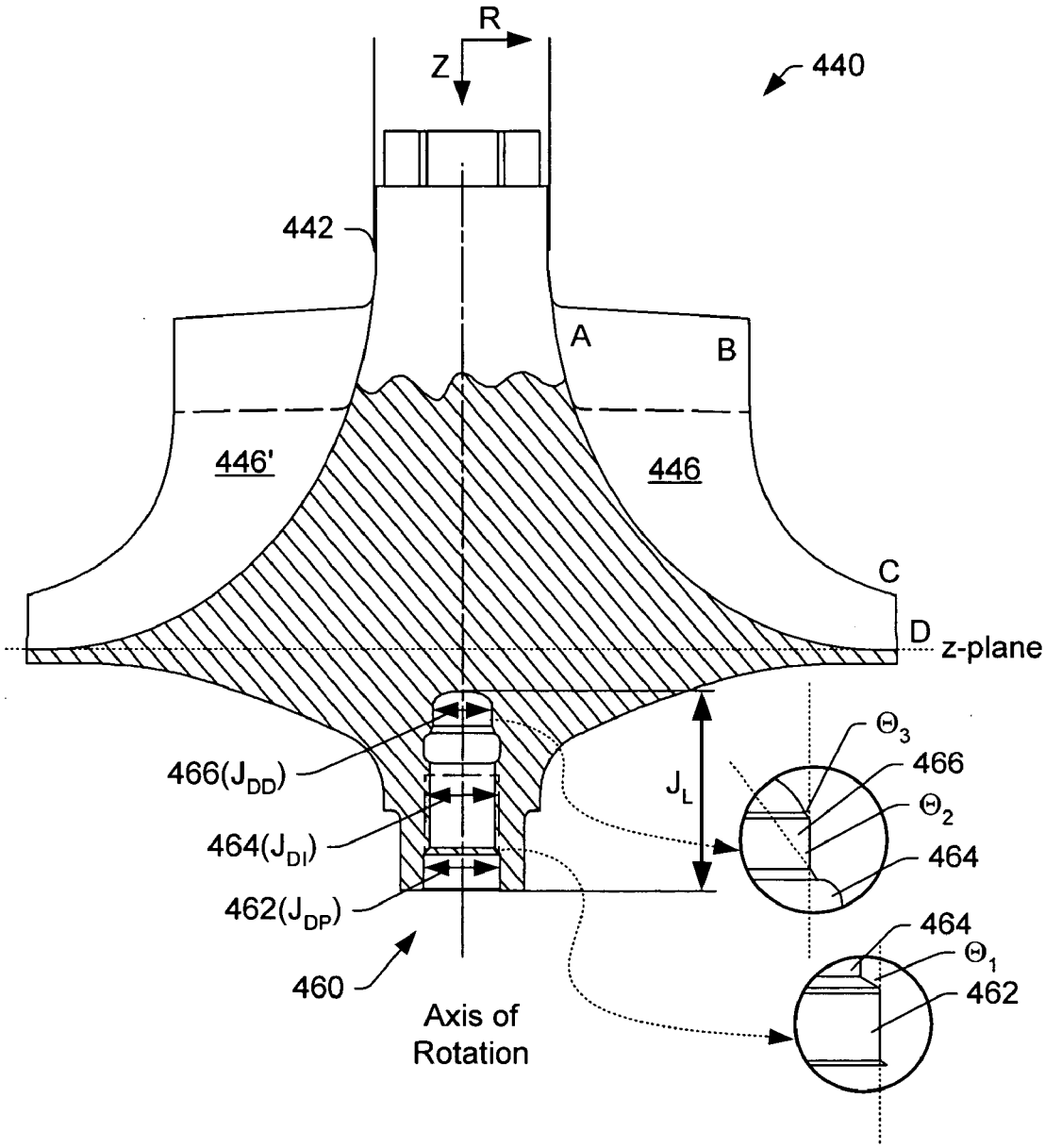
FIG. 4 is a cross-sectional view of an exemplary boreless compressor wheel that includes an exemplary joint.

FIG. 4 shows a cross-sectional view of a compressor wheel 440. The compressor wheel 440 includes a rotor 442, one or more blades 446, 446' and an axis of rotation and a z-plane. At one end of the compressor wheel 440, a joint 460 exists that has an axis substantially coincident along the axis of rotation of the rotor 442. In this example, the joint 460 includes a proximate region 462, an intermediate region 464 and a distal region 466. Such regions may be referred to as pilot regions and/or co-pilot regions or threaded regions, etc., as appropriate. The proximate region 462 includes a diameter $J_{DP}$ and a length (e.g., $\Delta h_P$), the intermediate region 464 includes a diameter $J_{DI}$ and a length (e.g., $\Delta h_1$), and the distal region 466 includes a diameter $J_{DD}$ and a length (e.g., $\Delta h_D$), wherein $d_P > d_1 > d_D$ and wherein the depth of the joint 460 corresponds to the length $J_L$ (e.g., approximately the sum of $\Delta h_P$, $\Delta h_1$, and $\Delta h_D$).

The intermediate region 464 further includes threads or other fixing mechanism (e.g., bayonet, etc.), which extends at least part of the entire length of the intermediate region 464. In one example, the intermediate region 464 includes approximately seven or more threads. Where threads are included, the threads of the intermediate region 464 typically match a set of threads of a compressor shaft, turbocharger shaft, turbine wheel shaft assembly, etc. Further, such a shaft, when received by the joint 460, typically does not extend to the end of the joint, i.e., does not extend to a depth $J_L$. Accordingly, an exemplary assembly may include a joint (e.g., the joint 460) that includes a proximate region, an intermediate region and a distal region and a turbocharger shaft inserted at least partially in the joint, wherein the shaft extends to at least a depth of a distal region. In such an exemplary assembly, a distal end of the shaft may actually extend into the distal region of the joint, generally to a depth that is less than the total depth of the joint, $J_L$.

FIG. 4 also shows additional, optional details of the joint 460, including an annular constriction disposed near the juncture of the proximate region 462 and the intermediate region 464, an annular constriction disposed near the juncture of the intermediate region 464 and the distal region 466, and a curved surface at the end of the distal region 466. The one or more annular constrictions decrease in diameter with respect to increasing length along the axis of rotation and may form a surface disposed at an angle with respect to the axis of rotation. For example, the annular constriction disposed near the juncture of the proximate region 462 and the intermediate region 464 may include an angle $\Theta_1$ while the annular constriction disposed near the juncture of the intermediate region 464 and the distal region 466 may include an angle $\Theta_2$. In one example, the angle $\Theta_1$ includes one or more angles selected from a range from approximately 50° to approximately 70°. In one example, the angle $\Theta_2$ includes one or more angles selected from a range from approximately 20° to approximately 40°. Of course, an exemplary joint may include one or more annular constrictions where one includes one or more angles selected from a range from approximately 50° to approximately 70° and where another includes one or more angles selected from a range from approximately 20° to approximately 40°. The distal region 466 may include an annular constriction with an angle $\Theta_3$. In this example, the angle $\Theta_3$ may be selected from a range from approximately 35° to approximately 55°.

With respect to the annular constriction near the juncture of the intermediate region 464 and the distal region 466, such a constriction may act to minimize or eliminate any damage created by machining (e.g., boring, taping, etc.). Further, an exemplary joint may have a non-threaded sub-region of the intermediate region 464 adjacent to the distal region 466 or adjacent to an annular constriction adjacent to the distal region 466. The exemplary joint 460 includes a non-threaded or threadless sub-region of the intermediate region 464 having a length equal to or less than the entire length of the intermediate region 464.

With respect to the blades 446, 446', such blades may be defined in the dimensions R and Z with respect to the points A, B, C and D. In one example, A is at approximately 40.6, 107; B is at approximately 107, 107; C is at approximately 187, 221; and D is at approximately 187, 238. In another example, A is at approximately 16, 42; B is at approximately 42, 42; C is at approximately 74, 87; and D is at approximately 74, 94. In these examples, the origin of a coordinate system may be positioned appropriately, generally at a point along the axis of rotation, and may coincide with a point on the hub or above the hub (i.e., away from the joint end).

Figure 5:
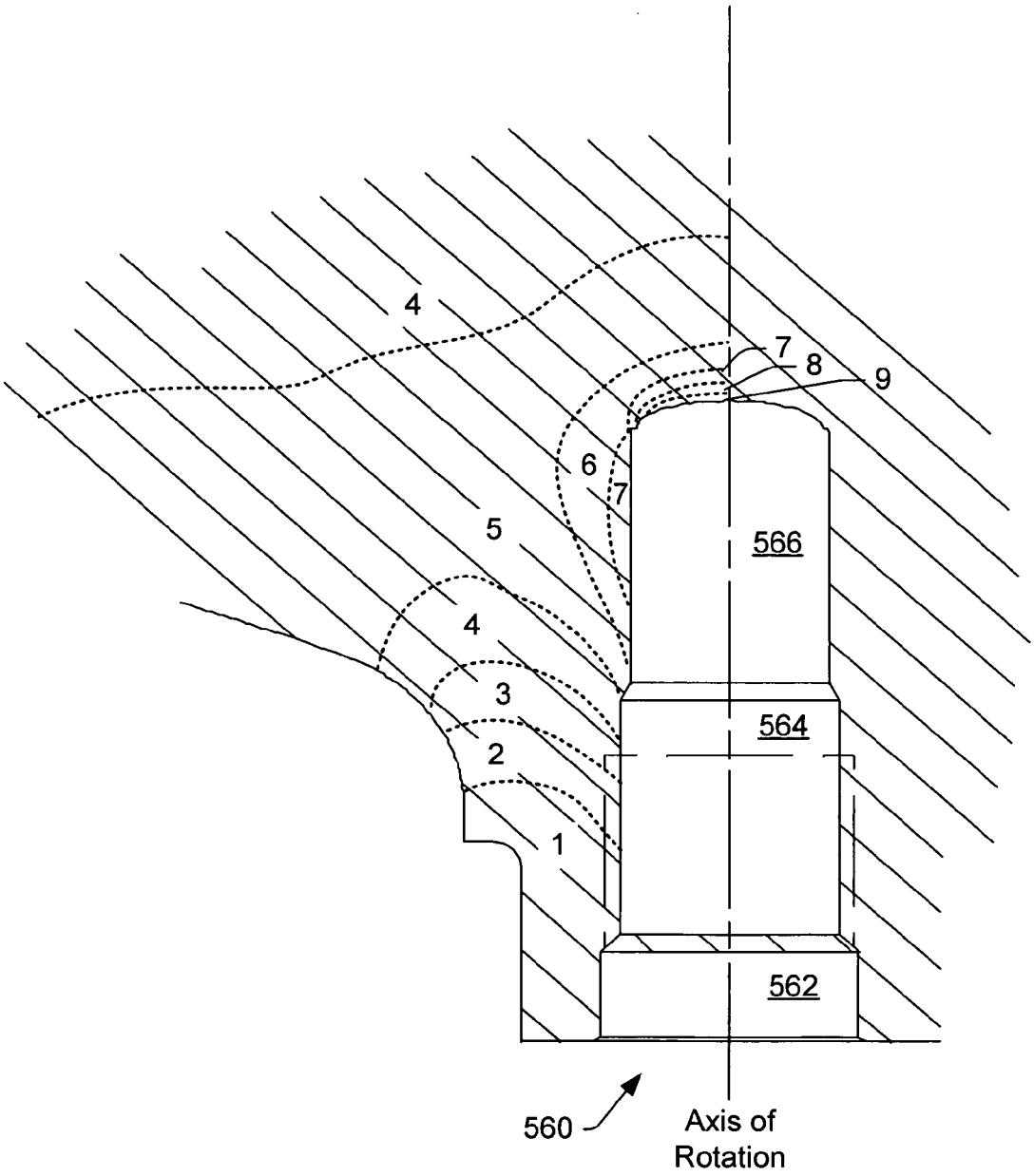
FIG. 5 is a contour plot of stress for an exemplary boreless compressor wheel joint

FIG. 5 shows a cross-sectional diagram 500 of an exemplary compressor wheel joint 560 along with stress contours (regions 1–9) associated with the joint 560. The compressor wheel joint 560 has a proximate region 562, an intermediate region 564 and a distal region 566. Accordingly, the highest level of stress appears at the end of the distal region 566 wherein the region 9 corresponds to the highest stress and the region 1 corresponds to the lowest stress. In this example, the highest level of stress occurs proximate to the end surface of the distal region 566 and along the axis of rotation. Thus, fatigue reduction techniques that reduce stress at or near the end surface can increase performance, longevity, etc., of a compressor wheel. Further, fatigue reduction techniques may allow for deeper boreless joints.

Figure 6:
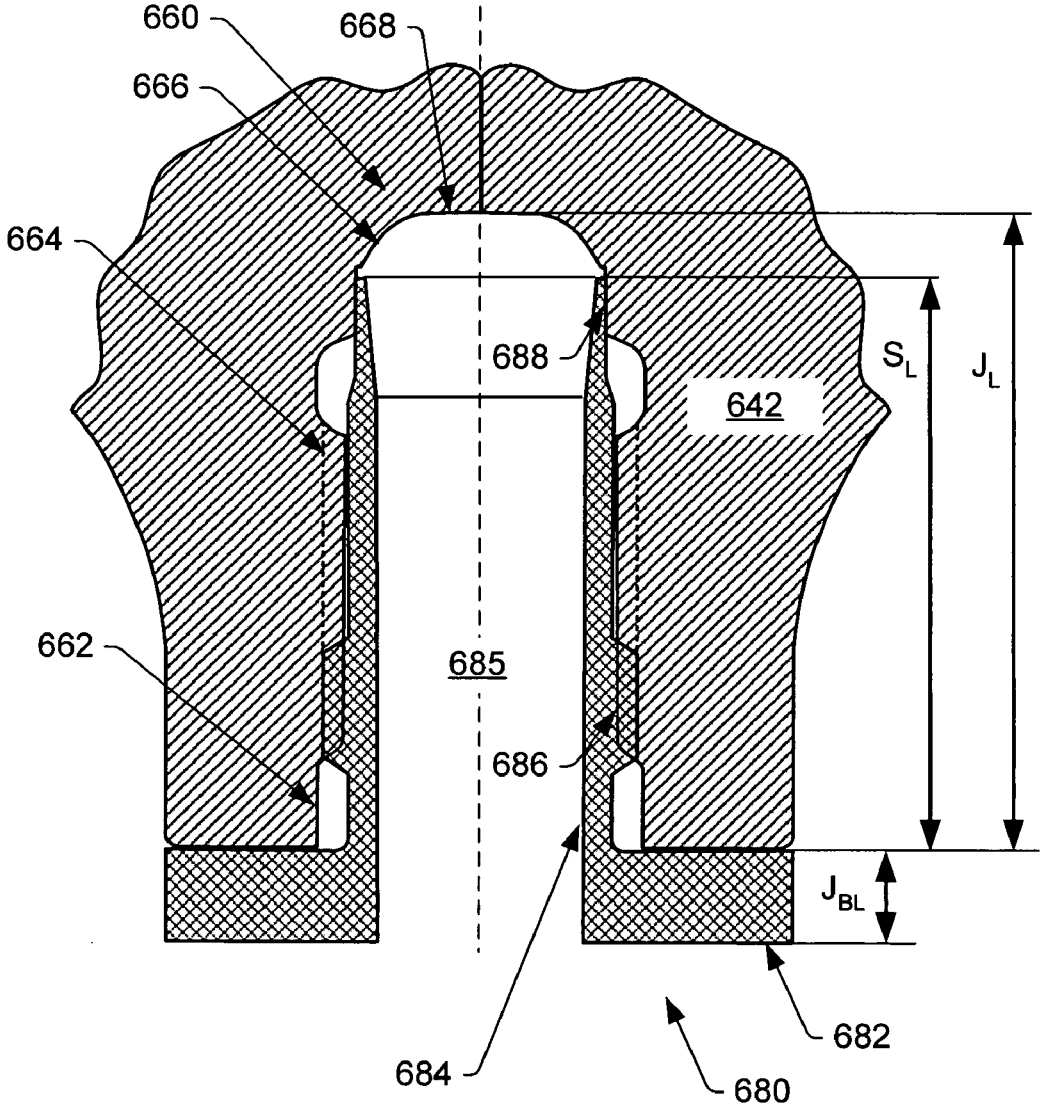
FIG. 6 is a cross-sectional view of the exemplary joint of the wheel of FIG. 4 and an exemplary shield.

FIG. 6 shows an exemplary shield 680 inserted in a joint 660 of a compressor wheel rotor 642 wherein the shield 680 allows for selective treatment of one or more inner surfaces of the joint 660. For example, the shield 680 can shield one or more surfaces of the joint 660 while allowing one or more other surfaces to be treated. The shield 680 can protect surfaces such as pilot, co-pilot, threads and/or thread relief area surfaces. Treatments may include cold working processes such as shot-peening, roll burnishing, etc. For example, a shot-peening process may spray glass beads or other material (e.g., aluminum oxide, plastic media, metal, alloy, etc.) at the end surface of a joint until a specified coverage is achieved using a required intensity level for a given bead classification. Of course, material other than bead shape may be used. Such requirements are outlined in SAE document AMS-S-13165. A roll burnishing process may be performed following an SAE or other procedure.

In FIG. 6, the joint 660 includes a proximate region 662, an intermediate region 664 and a distal region 666 that further includes an end surface 668. Again, as shown in the contour plot of FIG. 5, significant stress may exist at the end surface of a joint. In this example, the shield 680 includes a base portion 682 and an inner wall 684 that forms an inner passage 685 (e.g., channel, conduit, etc.). The base portion 682 of the shield 680 extends a length $J_{BL}$ beyond the outer end of the proximate region 662 of the joint 660. The shield 680 also extends a length $S_L$ in the joint 660, which has a length $J_L$. In an alternative example, a shield may not include a base portion and/or may include an inner wall that does not extend beyond the outer end of a proximate region of a joint.

The shield 680 may be secured in the joint 660 by an attachment mechanism 686 such as threads, bayonet, etc., and/or by a pressure fit between a surface 688 of the shield 680 and a surface of the joint 660. The attachment mechanism 686 cooperates with a corresponding mechanism in the joint 660. In addition, the shield 660 shields the attachment mechanism of the joint 660. Where at least a partially matching set of threads, bayonet, etc., are present, securing of the shield 680 in the joint 660 may occur by rotating either or both of the shield 680 and the compressor wheel rotor 642. Where a pressure fit mechanism is used to secure the shield, the pressure fit may be achieved by insertion and/or rotation.

In some instances, a distal region of an exemplary joint may have an end surface defined by three points $p_1$, $p_1'$ and $P_2$ wherein $P_2$ lies approximately along the axis of rotation and coincides approximately with an axial length (e.g., the depth of the joint, $J_L$). Points $p_1$, $p_1'$ and the point $p_2$ may be separated by a length $\Delta h_e$ along the axis of rotation. Thus, points p1 and p1' may be located at a length $J_L-\Delta h_e$ and along an inner diameter of a distal region. The points may help to define an end surface, in cross-section, having an elliptical shape. In one example, the elliptical shape is approximately a 3:1 ellipse. In another example, the end surface of a joint, in cross-section, has approximately a full radius or other shape that may help to reduce stress.

While aluminum and titanium compressor wheels are known, materials of construction for compressor wheels are not limited to aluminum and titanium and may include stainless steel, etc. Materials of construction optionally include alloys. For example, Ti-6Al-4V (wt.-%), also known as Ti6-4, is alloy that includes titanium as well as aluminum and vanadium. Such alloy may have a duplex structure, where a main component is a hexagonal α-phase and a minor component is a cubic β-phase stabilized by vanadium. Implantation of other elements may enhance hardness (e.g., nitrogen implantation, etc.) as appropriate.

Materials of construction for an exemplary shield may include one or more aforementioned materials and/or other materials. Such other materials include, but are not limited to, resins (e.g., any of a class of solid or semi-solid organic products of natural or synthetic origin, generally of high molecular weight and typically with no definite melting point; most resins are polymers). Materials of construction may include nylon, DELRIN® (E.I. du Pont de Nemours and Co., Inc., Delaware), etc.

Figure 7A:
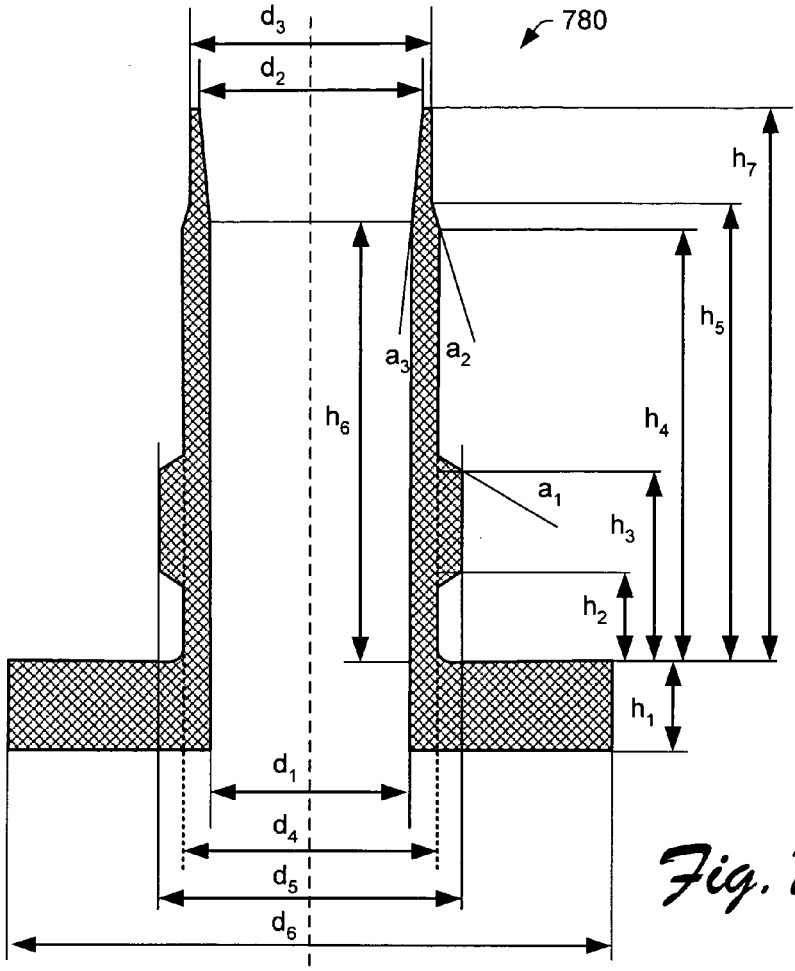
FIG. 7A is a cross-sectional view of the exemplary shield of FIG. 6.
Figure 7B:
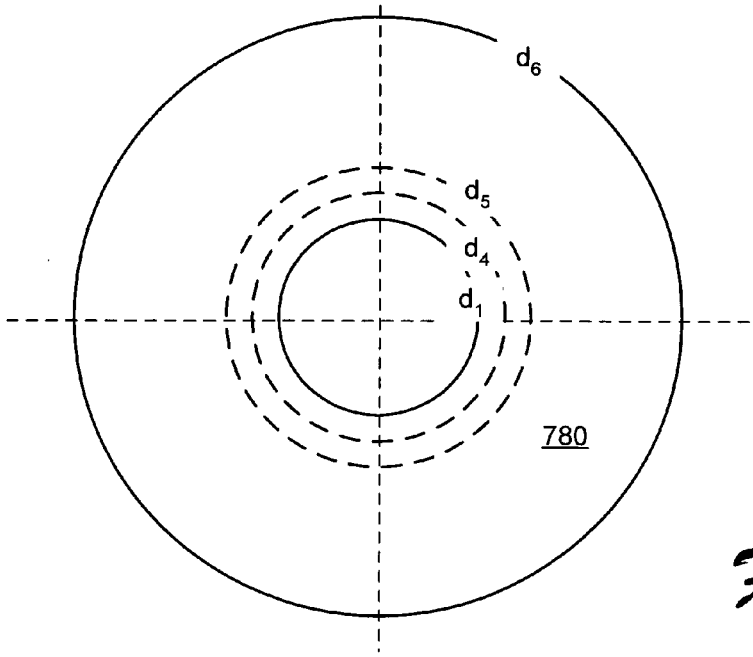
FIG. 7B is an approximate top view of the exemplary shield of FIG. 6.

FIGS. 7A and 7B show a cross-sectional view and a bottom view of an exemplary shield 780, respectively. The exemplary shield 780 includes a base portion having a length $h_1$, an outer diameter $d_6$ and an opening with an inner diameter $d_1$. A wall having a length $h_2$ and an inner diameter $d_1$ and an outer diameter $d_4$ extends from the base portion. An attachment mechanism section having a length of approximately $h_3-h_2$ extends radially outward from a diameter $d_4$ to a diameter $d_5$ (see, e.g., FIG. 7B). An upper portion of the attachment mechanism section may have an angle $a_1$ that optionally corresponds to the attachment mechanism (e.g., thread angle, etc.). In the exemplary shield 780, the wall extends upward to a length $h_7$ for a total length of $h_7+h_1$. At a length of about $h_4$ to a length of about $h_5$, the outer diameter of the wall angles inward (i.e., decreases) at an angle $a_2$ and at a length of about $h_6$ to a length of about $h_7$, the inner diameter of the wall angles outward (i.e., increases) at an angle $a_3$. At about a length of $h_7$, the wall has an inner diameter $d_2$ and an outer diameter $d_3$.

An exemplary shield has one or more of the following approximate dimensions:

| | |
|---|---|
| d1 | 0.82 |
| d2 | 0.91 |
| d3 | 1.00 |
| d4 | 1.06 |
| d6 | 2.5 |
| h1 | 0.38 |
| h2 | 0.38 |
| h3 | 0.80 |
| h4 | 1.81 |
| h7 | 2.32 |
| a1 | 30° |
| a2 | 15° |

Some of these dimensions may be used to determine ratios of various features of an exemplary shield, as appropriate.

Figure 8A:
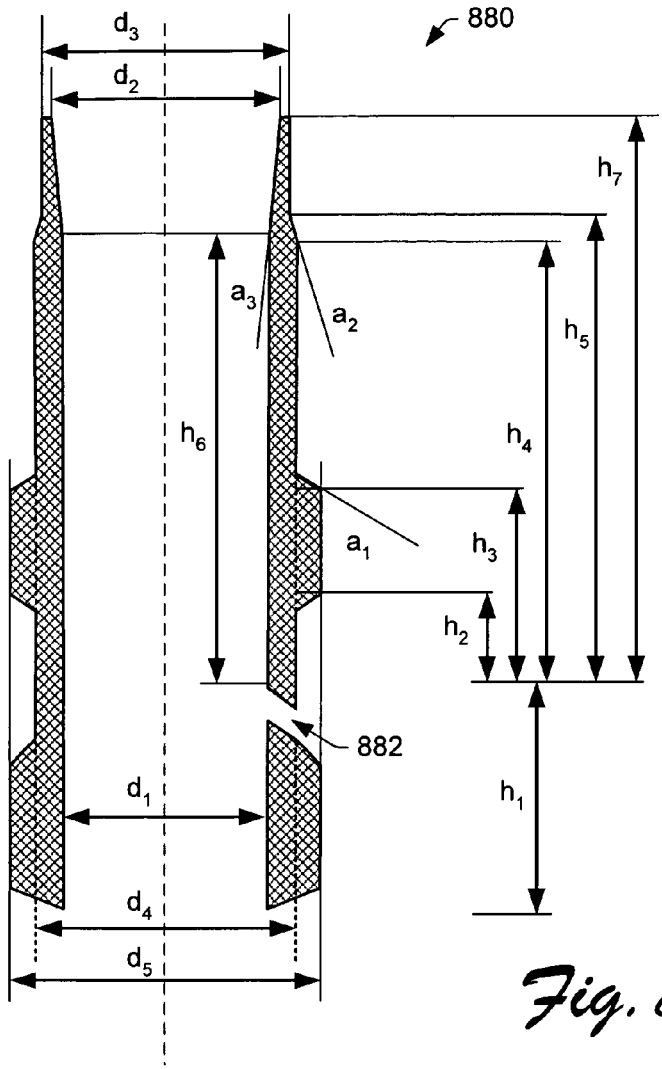
FIG. 8A is a cross-sectional view of an exemplary shield that includes a fitting.
Figure 8B:
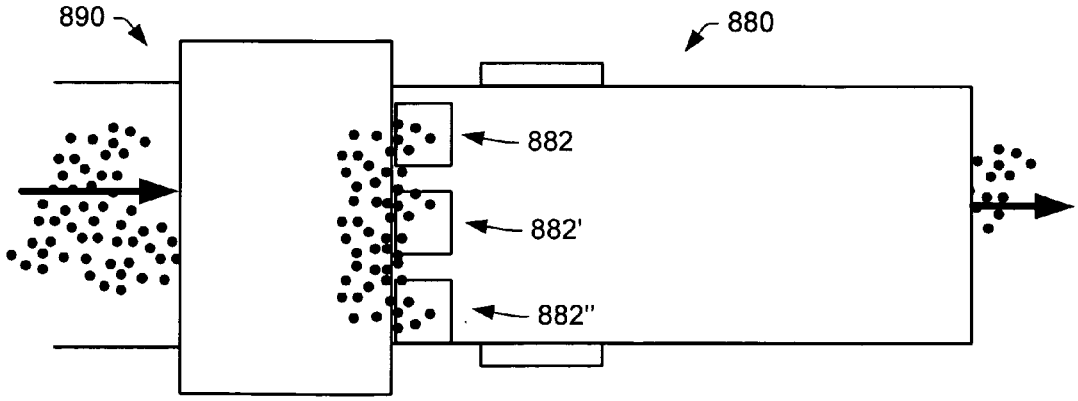
FIG. 8B is a side view of the exemplary shield of FIG. 8A that further illustrates use of particles for surface treatment.

FIGS. 8A and 8B show a cross-sectional view of an exemplary shield 880 and an approximate side view of the exemplary shield 880 and an attached tube/fitting 890, respectively. The exemplary shield 880 includes a base portion having a length $h_1$, an outer diameter $d_5$ and an opening with an inner diameter $d_1$. The length $h_1$ of the base portion commences approximately at a predominantly radial opening 882, shown in FIG. 8B as a plurality of openings 882, 882', 882". Such openings allow treatment material to exit the shield, preferably after impinging on one or more unprotected and/or selected surfaces of a joint of a compressor wheel.

In this example, the base portion may include threads or other attachment mechanism (e.g., extending radially outward from a diameter $d_4$ to the diameter $d_5$) for attachment to a hose, tube, etc., or a fitting of a hose, tube, etc., associated with a cold working or other process for surface treatment.

A wall having a length $h_2$ and an inner diameter $d_1$ and an outer diameter $d_4$ extends from the base portion. An attachment mechanism section having a length of approximately $h_3-h_2$ extends radially outward from a diameter $d_4$ to a diameter $d_5$. An upper portion of the attachment mechanism section may have an angle $a_1$ that optionally corresponds to the attachment mechanism (e.g., thread angle, etc.). In the exemplary shield 780, the wall extends upward to a length $h_7$ for a total length of $h_7+h_1$. At a length of about $h_4$ to a length of about $h_5$, the outer diameter of the wall angles inward (i.e., decreases) at an angle $a_2$ and at a length of about $h_6$ to a length of about $h_7$, the inner diameter of the wall angles outward (i.e., increases) at an angle $a_3$. At about a length of $h_7$, the wall has an inner diameter $d_2$ and an outer diameter $d_3$.

In an alternative example, an attachment mechanism of a base portion may differ from an attachment mechanism of an insert portion. For example, an insert portion for insertion in a joint may use pressure fit and a base portion may use a bayonet to attach to fitting of a tube, hose, etc., associated with a cold working process.

Figure 9:
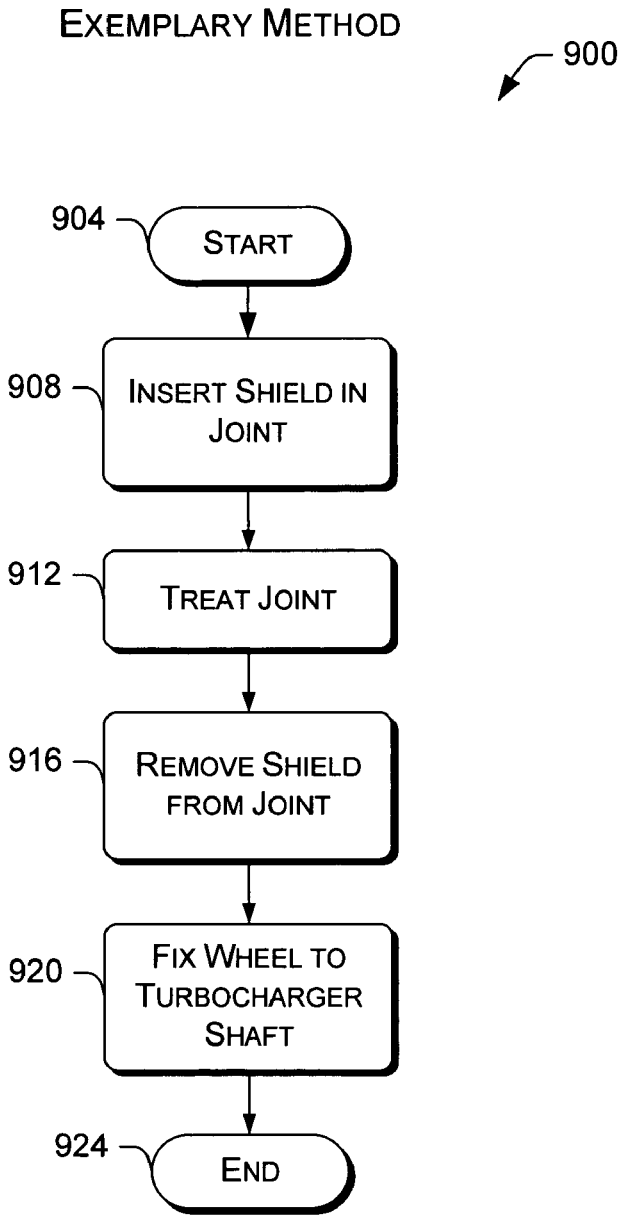
FIG. 9 is a block diagram of an exemplary method for surface treating at least part of a joint of a boreless compressor wheel.

FIG. 9 shows a block diagram of an exemplary method 900. The method 900 commences in a start block 904, which includes providing a compressor wheel and a shield. In an insertion block 908, the compressor wheel, having a joint, receives at least a portion of a shield to an appropriate depth to thereby protect one or more surfaces of the joint. A treatment block 912 follows wherein a surface treatment process occurs that aims to reduce fatigue. After the treating, in a removal block 916, the shield is removed from the joint of the compressor wheel. Next, in fixation block 920, the compressor wheel joint receives, at least partially, an operational shaft, such as, a turbocharger shaft. The method 900 may terminate in an end block 924. The method 900 optionally includes a balancing block before and/or after the treatment block 912 wherein the compressor wheel and/or compressor wheel and operational shaft are balanced.

The exemplary method 900 and/or portions thereof are optionally performed using hardware and/or software. For example, the method and/or portions thereof may be performed using robotics and/or other computer controllable machinery.

As described herein such an exemplary method or steps thereof are optionally used to produce a compressor wheel having advantageous fatigue characteristics. Various exemplary compressor wheels disclosed herein include a proximate end, a distal end, an axis of rotation, a z-plane positioned between the proximate end and the distal end, and a joint having an axis coincident with the axis of rotation and an end surface. Such an end surface optionally has an elliptical cross-section (e.g., radius to height ratio of approximately 3:1, etc.). Such a compressor wheel optionally includes aluminum, titanium, titanium alloy (e.g., Ti6-4, etc.) or other material having suitable mechanical properties. Such a compressor wheel optionally has, prior to and/or after treatment, a peak principle operational stress proximate to the end surface and proximate to the axis of rotation that does not exceed the yield stress. Various exemplary compressor wheels are optionally part of an assembly (e.g., a balancing assembly, a turbocharger assembly, a compressor assembly, etc.).

CONCLUSION

Although some exemplary methods, devices, systems, etc., have been illustrated in the accompanying Drawings and described in the foregoing Detailed Description, it will be understood that the methods, devices, systems, etc., are not limited to the exemplary embodiments disclosed, but are capable of numerous rearrangements, modifications and substitutions without departing from the spirit set forth and defined by the following claims.

What is claimed is:

1. A shield comprising:

an attachment mechanism disposed on an outer surface to attach the shield to a joint of a boreless compressor wheel wherein the attachment mechanism allows for removal of the shield prior to fitting an operational shaft to the boreless compressor wheel; and a passage extending from a proximate end of the shield to a distal end of the shield.

2. The shield of claim 1 wherein the attachment mechanism comprises threads.

3. The shield of claim 1 wherein the passage provides access to an end surface of a joint of a boreless compressor wheel when the shield is inserted at least partially in the joint.

4. The shield of claim 1 comprising a resin.

5. The shield of claim 4 wherein the resin comprises a polymer.

6. The shield of claim 1 wherein the attachment mechanism comprises an outer surface capable of being in contact with a surface of a joint of a boreless compressor wheel.

7. The shield of claim 1 wherein the shield prevents material entering the passage from contacting a pilot surface of a joint of a boreless compressor wheel.

8. The shield of claim 1 wherein the shield prevents material entering the passage from contacting an attachment mechanism of a joint of a boreless compressor wheel.

9. The shield of claim 1 further comprising a base portion that includes an attachment mechanism to attach the shield to a fitting of a tube associated with a cold working process.

10. The shield of claim 1 further comprising a base portion that includes one or more openings that allow material associated with a cold working process to exit the passage.

11. The shield of claim 1 further comprising a pressure fit surface positioned proximate to the distal end of the shield to form a pressure fit with a surface of a joint of a boreless compressor wheel.

12. The shield of claim 1 further comprising a boreless compressor wheel.

13. An assembly comprising:

a boreless compressor wheel that includes a joint; and a shield that comprises an attachment mechanism disposed on an outer surface to attach the shield to the joint and a passage extending from a proximate end of the shield to a distal end of the shield wherein the attachment mechanism allows for removal of the shield prior to fitting an operational shaft to the boreless compressor wheel.

14. The assembly of claim 13 wherein the passage allows material associated with a cold working process to contact an end surface of the joint without contacting one or more other surfaces of the joint.

15. A boreless compressor wheel comprising a joint that includes an end surface at least partially treated by a cold working, and a shaft inserted at least partially in the joint, the shaft contacting an untreated pilot surface of the joint.

16. A method comprising:

inserting a shield at least partially in a joint of a boreless compressor wheel;

treating, at least partially, an end surface of the joint to thereby reduce fatigue of the boreless compressor wheel; and removing the shield from the joint.

17. The method of claim 16 wherein the treating comprises a cold working process.

18. The method of claim 16 wherein the treating comprises shot-peening.

19. The method of claim 16 wherein the inserting comprises rotating.

20. A shield comprising:

an attachment mechanism disposed on an outer surface to attach the shield to a joint of a boreless compressor wheel wherein the attachment mechanism comprises threads; and a passage extending from a proximate end of the shield to a distal end of the shield.

21. A shield comprising:

a resin;

an attachment mechanism disposed on an outer surface to attach the shield to a joint of a boreless compressor wheel; and a passage extending from a proximate end of the shield to a distal end of the shield.

22. The shield of claim 21 wherein the resin comprises a polymer.

23. A shield comprising:

an attachment mechanism disposed on an outer surface to attach the shield to a joint of a boreless compressor wheel;

a passage extending from a proximate end of the shield to a distal end of the shield; and a base portion that includes an attachment mechanism to attach the shield to a filling of a tube associated with a cold working process.

* * * * *